US008381865B2

(12) United States Patent
Okada

(10) Patent No.: US 8,381,865 B2
(45) Date of Patent: Feb. 26, 2013

(54) CONSTRUCTION MACHINE

(75) Inventor: Koji Okada, Hiroshima (JP)

(73) Assignee: Kobelco Construction Machinery Co., Ltd., Hiroshima-shi (JP)

( * ) Notice: Subject to any disclaimer, the term of this patent is extended or adjusted under 35 U.S.C. 154(b) by 595 days.

(21) Appl. No.: 12/581,333

(22) Filed: Oct. 19, 2009

(65) Prior Publication Data

US 2010/0122865 A1 May 20, 2010

(30) Foreign Application Priority Data

Nov. 20, 2008 (JP) ..... 2008-296821

(51) Int. Cl.
*B60K 13/04* (2006.01)

(52) U.S. Cl. ..... 180/309; 180/296; 60/272

(58) Field of Classification Search ..... 180/296, 180/309; 248/49–74.5; 60/272–324
See application file for complete search history.

(56) References Cited

U.S. PATENT DOCUMENTS

| | | | | |
|---|---|---|---|---|
| 4,060,143 | A * | 11/1977 | Matsumoto et al. | 180/296 |
| 5,832,726 | A * | 11/1998 | Rees et al. | 60/322 |
| 6,022,254 | A * | 2/2000 | Neisen | 440/89 R |
| 6,164,062 | A * | 12/2000 | Blichmann | 60/272 |
| 6,983,728 | B1 * | 1/2006 | Banks et al. | 123/198 R |
| 8,191,668 | B2 * | 6/2012 | Keane et al. | 180/296 |
| 2010/0275588 | A1 * | 11/2010 | Kamata et al. | 60/322 |
| 2011/0120085 | A1 * | 5/2011 | Saito et al. | 60/272 |

FOREIGN PATENT DOCUMENTS

| | | |
|---|---|---|
| JP | Sho 50-15911 | 2/1975 |
| JP | Sho 55-181319 | 12/1980 |
| JP | Hei 03-037020 | 4/1991 |
| JP | 10-317957 | 12/1998 |
| JP | 2003-104071 | 4/2003 |
| JP | 2003-201837 | 7/2003 |
| JP | 2007-331602 | 12/2007 |

OTHER PUBLICATIONS

U.S. Appl. No. 12/619,888, filed Nov. 17, 2009, Okada.
Japanese Office Action mailed Sep. 4, 2012 in Japanese Patent Application No. 2008-296821 filed Nov. 20, 2008 (with English translation).

* cited by examiner

*Primary Examiner* — John R Olszewski
*Assistant Examiner* — Jacob Meyer
(74) *Attorney, Agent, or Firm* — Oblon, Spivak, McClelland, Maier & Neustadt, L.L.P.

(57) ABSTRACT

A gate-shaped muffler mount including front and rear leg portions and a muffler attaching portion is attached to a mounting bracket for supporting an engine with bolts so as to straddle a hydraulic pump. One of mounting holes has a diameter larger than the diameter of the bolt, and the muffler mount is therefore rotatable around the other bolt along the axial direction of a bellows. By this rotation, the bellows can be positionally adjusted in the axial direction relative to an engine exhaust pipe so that assembly errors can be absorbed.

8 Claims, 4 Drawing Sheets

PRIOR ART

CONSTRUCTION MACHINE

BACKGROUND OF THE INVENTION

1. Field of the Invention

The present invention relates to a construction machine, such as a hydraulic shovel, having a muffler mounting device for mounting a muffler used in an engine exhaust system, in an engine room.

2. Description of the Related Art

A hydraulic shovel will be taken as an example to describe the background art.

FIG. 6 shows an upper rotating body mounted on a lower traveling body. In the figure, reference numeral 1 denotes an upper frame of the upper rotating body. At one end (at the left side end in the figure, the side of this end will hereinafter be referred to as front) of the upper frame 1, a working attachment (not shown) including a boom, an arm, and a bucket is attached.

On the upper surface of the upper frame 1, on both sides of the middle portion in the left-right direction and over substantially the entire length in the front-rear direction, longitudinal plates (also referred to as main frames) 2 and 3 serving as strength members are provided, and in the rear, partition walls 4 to 6 extending in the left-right direction are provided. At the rear end of the upper frame divided by the partition walls 4 to 6, an engine room 7 is formed.

In the engine room 7, an engine 8 is provided between the left and right longitudinal plates 2 and 3, and on the left side of the engine 8, a cooling fan 9 and a heat exchanger 10, such as an intercooler, a radiator, or an oil cooler, are provided as a cooling installation.

On the right side of the engine 8, a hydraulic pump 11 is provided so as to be connected to the output shaft of the engine, and a muffler 12 is placed over the hydraulic pump 11.

In a conventional muffler mounting device, as shown in FIG. 7, a muffler mount 13 projects from the pump side surface of the engine 8, and the muffler 12 is placed on the muffler mount 13 and is secured with a U-shape bolt 14 (see Japanese Unexamined Patent Application Publication Nos. 2003-104071 and 10-317957).

The inlet side (the engine side) of the muffler 12 is connected to an engine exhaust pipe through an accordion-pleated bellows for absorbing the relative displacement of the engine 8 and the muffler 12 due to vibration. During assembly (when the muffler and the exhaust pipe are connected), some assembly errors including that in the axial direction of the bellows can be absorbed by the deformation of the bellows.

However, in this art, the bellows is the only device for absorbing assembly errors. Therefore, the only way to absorb errors beyond the adjusting capability of the bellows is to enhance the adjusting capability by lengthening the bellows. This leads to higher cost.

In addition, the bellows is formed of metal and a substantial force is needed to deform it. Therefore, the position adjusting operation relative to the exhaust pipe is troublesome.

SUMMARY OF THE INVENTION

An object of the present invention is to provide a construction machine having a muffler mounting device that can improve the position adjusting function of a bellows for absorbing assembly errors and can facilitate the position adjusting operation.

In an aspect of the present invention, a construction machine includes a hydraulic pump connected to one end in the axial direction of an engine, a muffler placed on the side of the engine to which the hydraulic pump is connected, and a muffler mounting device by which the inlet side of the muffler is connected through a bellows to an exhaust pipe of the engine. By a position adjusting device, a muffler mount is provided on the muffler side of the engine so as to be positionally adjustable in the axial direction of the bellows. The muffler is attached to the muffler mount.

Due to the position adjusting function of the muffler mount due to the position adjusting device, the bellows can be positionally adjusted in the axial direction when connected with the exhaust pipe. Therefore, the bellows itself need not have an adjusting function in the axial direction. Therefore, the size of the bellows in the axial direction can be reduced, and the cost can be reduced.

Compared to deforming the bellows itself, the position adjusting operation is easy, and the assembly is easy.

It is preferable that the muffler mount include at least one leg portion and a muffler attaching portion provided at the upper part of the at least one leg portion, the muffler be attached to the muffler attaching portion, the lower part of the at least one leg portion be attached to a mount attaching bracket provided in a frame of the construction machine so as to be rotatable around a pivot along the axial direction of the bellows, and the position adjusting device be thereby constructed.

In this case, the muffler mount rotates around the pivot provided at the lower part of the at least one leg portion and performs a position adjusting function. Therefore, a substantial force is not needed for the operation. Just by rotating the muffler mount slightly, a wide adjustment range in the axial direction of the bellows can be achieved. Therefore, the adjusting operation is facilitated.

It is preferable that the at least one leg portion include a pair of leg portions facing each other with a space therebetween, the muffler mount be formed in a gate shape such that the muffler attaching portion is laid between the upper ends of the pair of leg portions, and the pair of leg portions be attached to the mount attaching bracket so as to straddle the hydraulic pump.

In this case, since the mount is gate-shaped and is provided so as to straddle the hydraulic pump, the mount does not interfere with the attaching and removal of the hydraulic pump, and the muffler can be placed at the conventional position. That is, it is not necessary to rearrange or resize the pump and other surrounding devices, and the muffler mounting device can be easily applied to existing machines.

In addition, since the gate-shaped mount supports the weight of the muffler at both ends, the muffler can be stably supported even when the muffler is a heavy muffler with an exhaust emission control system.

It is preferable that the at least one leg portion of the muffler mount and the mount attaching bracket be each provided with first and second mounting holes through which bolts are passed, the second mounting hole of at least one of the at least one leg portion and the mount attaching bracket be of a size such that the bolt has sufficient clearance when passed through the second mounting hole, and the muffler mount be thereby attached rotatably around the bolt passed through the first mounting holes within the clearance of the second mounting hole along the axial direction of the bellows.

In this case, since the mount attaching members (the mount attaching bracket, the mounting holes, and the bolts) serve as components of the position adjusting device, the structure can be simplified, and the cost can be reduced.

It is preferable that the at least one leg portion and the muffler attaching portion of the muffler mount be formed separately, and the muffler attaching portion be joined to the at least one leg portion so as to be movable relative to the at least one leg portion in the axial direction of the bellows.

In this case, the mount attaching members (the mount attaching bracket, the mounting holes, and the bolts) serve as components of the position adjusting device, and due to adjusting mechanisms at two points, the position adjustment range in the axial direction of the bellows is wide.

It is preferable that the at least one leg portion and the muffler attaching portion of the muffler mount be formed separately, and the muffler attaching portion be joined to the at least one leg portion so as to be movable relative to the at least one leg portion in the horizontal direction perpendicular to the axial direction of the bellows.

In this case, since position adjustment can also be performed in the direction perpendicular to the axial direction of the bellows, the assembly can be further facilitated.

It is preferable that the mount attaching bracket be provided in a longitudinal plate provided in the frame of the machine in the front-rear direction and serving as a strength member.

In this case, the muffler can be stably supported by the longitudinal plate of the machine frame serving as a strength member.

It is preferable that the muffler mount be attached to an engine mounting bracket that supports the engine, and the engine mounting bracket serve as a mount attaching bracket.

In this case, since the engine mounting member serves as a mount attaching bracket, the structure can be further simplified.

DESCRIPTION OF THE PREFERRED EMBODIMENTS

Figure 1:
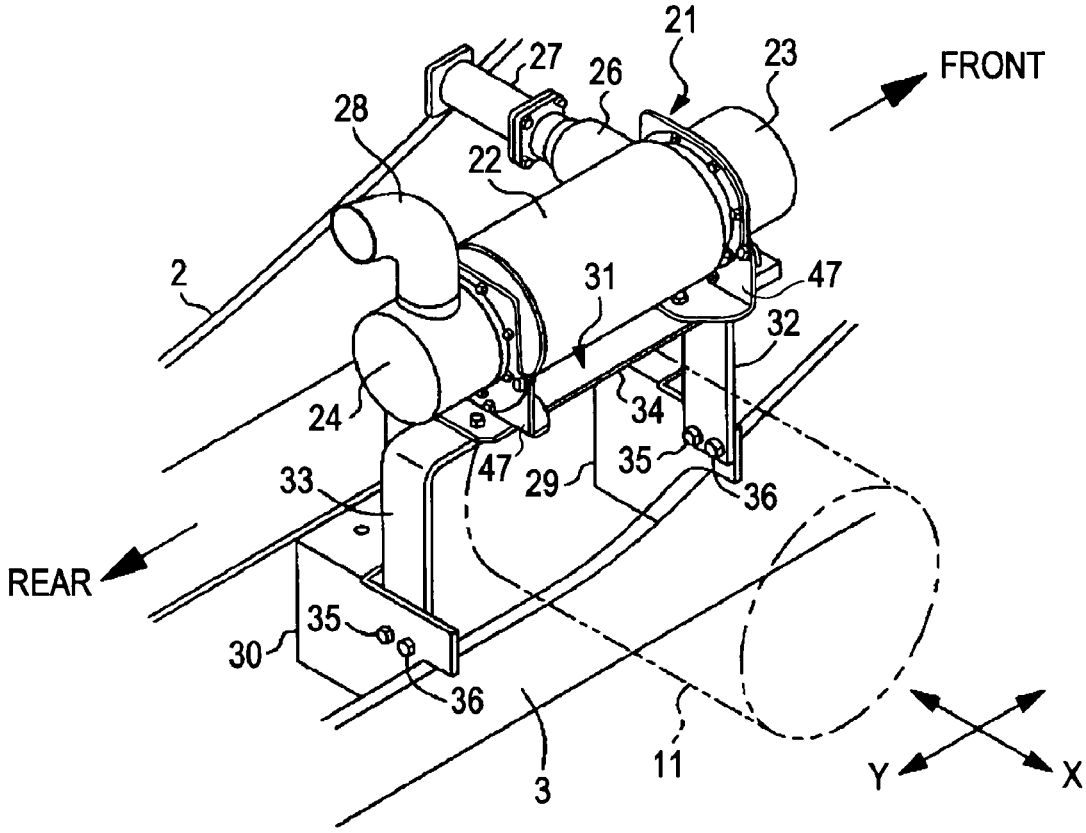
FIG. 1 is a perspective view of a muffler mounting device according to an embodiment of the present invention.

Embodiments of the present invention will be described with reference to FIGS. 1 to 5.

In the embodiments, the present invention is applied to a hydraulic shovel.

As in the art described in the related art, an engine room is formed at the rear end of an upper rotating body, an engine is placed in the engine room, a hydraulic pump 11 (shown by long dashed double-short dashed line in FIGS. 1 and 2) is connected to the right side of the engine, and a muffler 21 is placed over the hydraulic pump 11.

The muffler 21 includes an exhaust emission control system 22 that removes NOx (nitrogen oxides) and PM (Particulate Matters) from exhaust gas, and silencers 23 and 24 provided on the inlet (engine) side and the outlet side of the exhaust emission control system 22. The exhaust emission control system 22 and the silencers 23 and 24 are flange-connected in the axial direction of the muffler. The inlet side silencer 23 is connected to an introduction tube 25 (shown in FIG. 3). The introduction tube 25 is connected to a metal accordion-pleated bellows 26. The bellows 26 is connected to an engine exhaust pipe 27.

Figure 2:
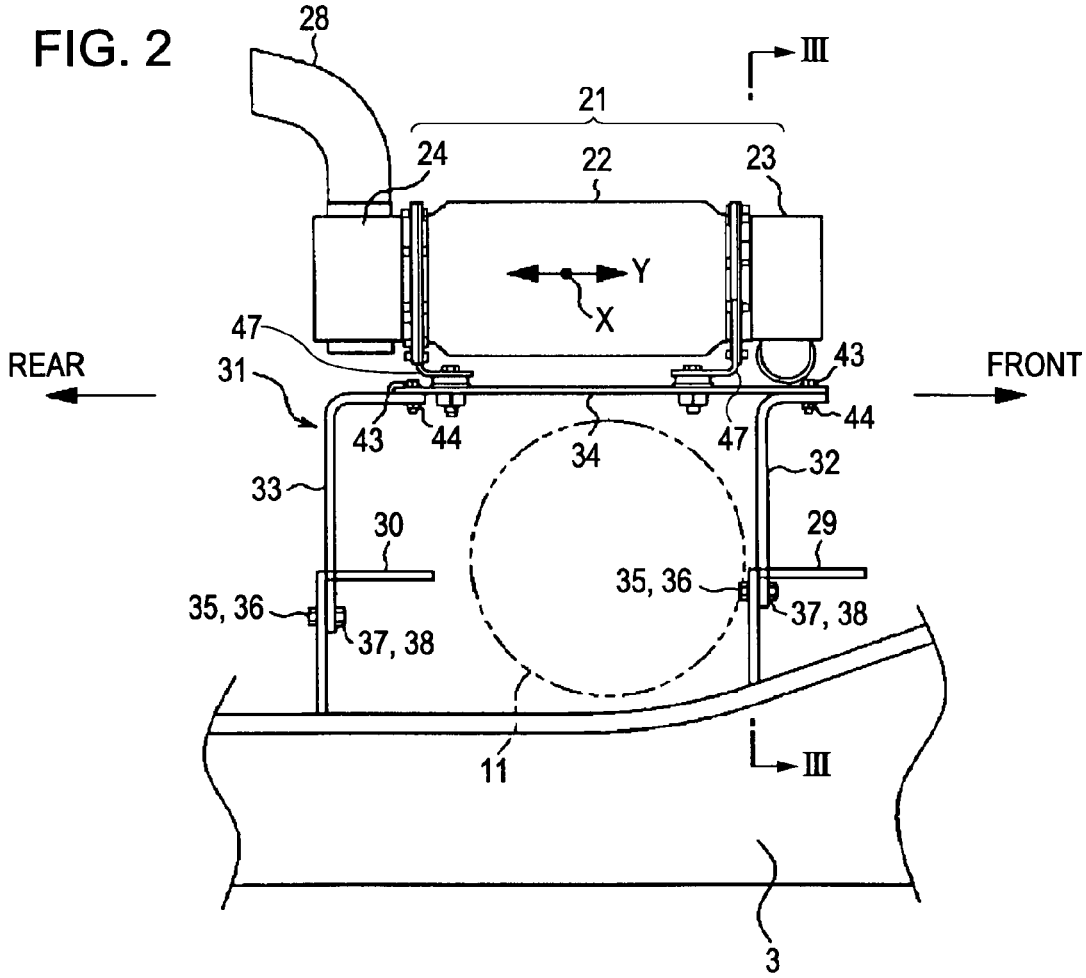
FIG. 2 is a side view of same.
Figure 3:
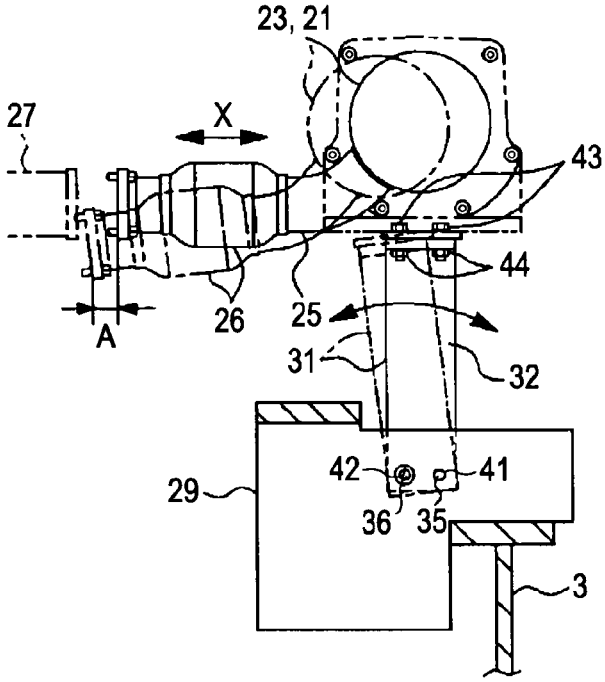
FIG. 3 is a sectional view taken along line III-III of FIG. 2.

In FIGS. 1 and 2, reference numeral 28 denotes an exhaust duct connected to the outlet side silencer 24.

Figure 6:
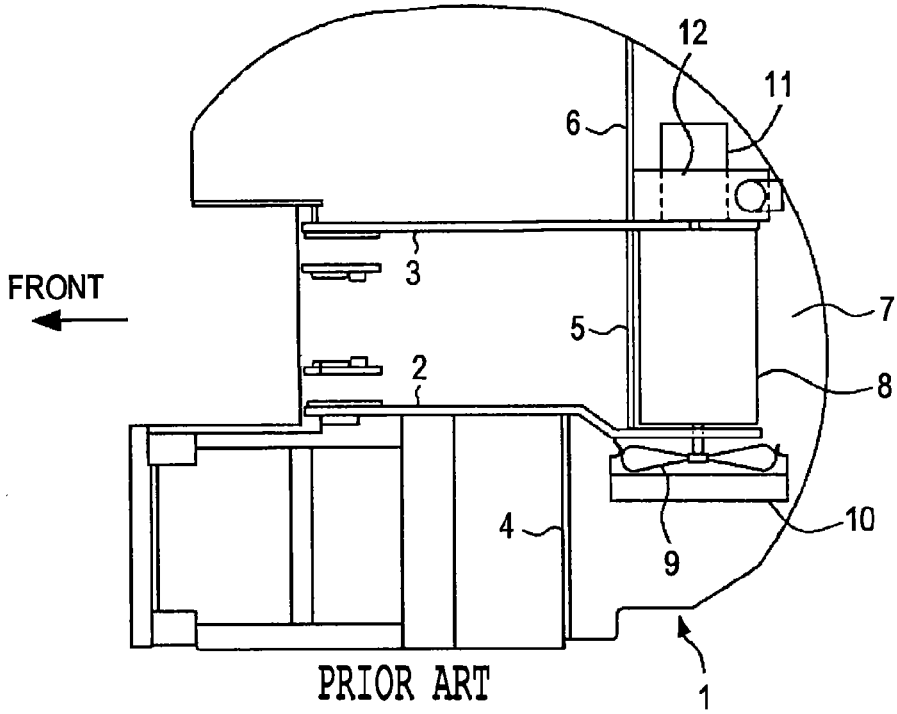
FIG. 6 is a schematic plan view showing an upper frame and the equipment layout in an engine room of a hydraulic shovel.
Figure 7:
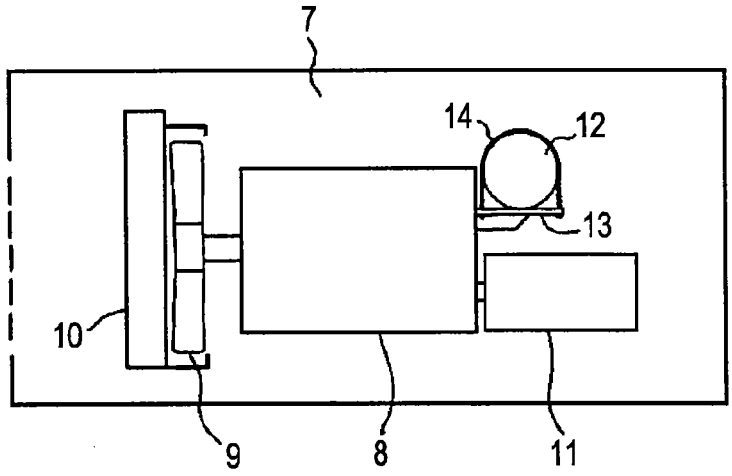
PRIOR ART FIG. 7
FIG. 7 is a rear view of same.

Left side and right side longitudinal plates 2 and 3 are provided on an upper frame of the upper rotating body. Engine mounting brackets 29 and 30 that support one end of the engine 8 shown in FIGS. 6 and 7 are attached to both the front and rear sides of the upper surface of the right side longitudinal plate 3. A muffler mount 31 that supports the muffler 21 is attached to the engine mounting brackets (hereinafter simply referred to as mounting brackets) 29 and 30.

The muffler mount 31 is formed in a gate shape and includes three separate members: a pair of leg portions 32 and 33 facing each other with a space therebetween in the front-rear direction, and a muffler attaching portion 34 laid horizontally between the upper ends of the leg portions 32 and 33. The lower ends of the leg portions 32 and 33 are attached to the front and rear mounting brackets 29 and 30 with first and second bolts 35 and 36 and first and second nuts 37 and 38.

Thus, the gate-shaped muffler mount 31 is fixed in the engine room so as to straddle the hydraulic pump 11 as shown in FIGS. 1 and 2 and to be perpendicular to the axial direction of the bellows 26 (the X direction in FIGS. 1 to 3 and 5) (see FIGS. 1 and 2).

Figure 4:
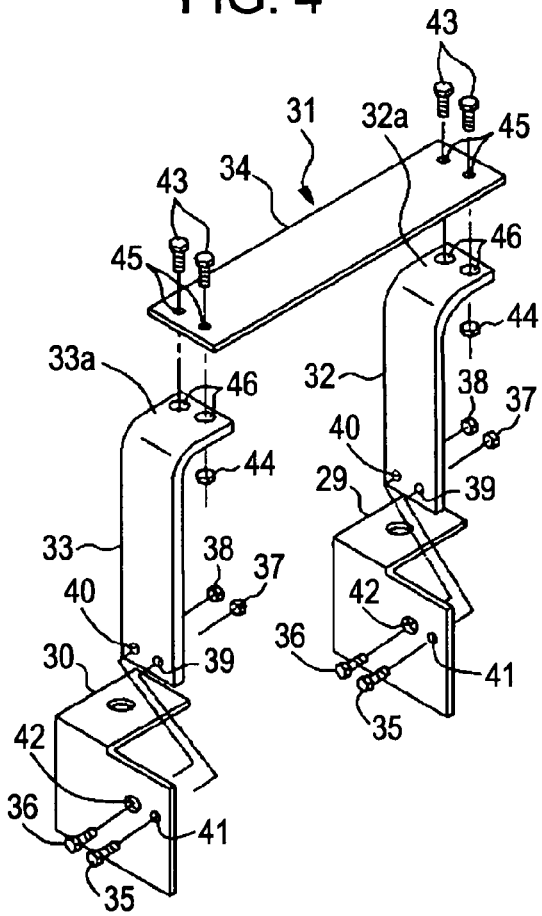
FIG. 4 is an exploded perspective view of a muffler mount constituting the device.

As shown in FIG. 4, first and second mounting holes 39 and 40 through which the bolts 35 and 36 are passed are provided on the left and right sides of the lower end of each of the leg portions 32 and 33, and similar first and second mounting holes 41 and 42 are provided in each of the mounting brackets 29 and 30.

The first mounting holes 41 of the mounting brackets 29 and 30 and the mounting holes 39 and 40 of the leg portions 32 and 33 are circular holes with substantially the same diameter as the bolt diameter of the first and second bolts 35 and 36 (a minimum diameter needed for the bolts 35 to be passed through the mounting holes).

On the other hand, the second mounting holes 42 of the mounting brackets 29 and 30 are circular holes with a diameter larger than the diameter of the second bolts 36 so that the bolts 36 have sufficient clearance when passed through the mounting holes 42 (so-called clearance holes). The mounting holes 42 may be elongate holes that are vertically long. So, the second bolts 36 can move freely within the clearance in the second mounting holes 42.

Thus, the muffler mount 31 (the leg portions 32 and 33) is attached to the mounting brackets 29 and 30 so as to be rotatable from side to side along the X direction around the first bolts 35.

That is, the mounting brackets 29 and 30, the mounting holes 39 to 42, the bolts 35 and 36, and the nuts 37 and 38 serving as mount attaching members for attaching the muffler mount 31 constitute a position adjusting device. Due to the position adjusting device, the muffler mount 31 and therefore the muffler 21 mounted on the mount 31 can be positionally adjusted in the X direction (in the axial direction of the bellows).

Due to this position adjusting function, the bellows 26 can be positionally adjusted in the axial direction when connected with the exhaust pipe 27. Therefore, the bellows itself need not have an adjusting function in the axial direction. Therefore, the size of the bellows 26 in the axial direction can be reduced to a minimum length needed to absorb the relative displacement of the engine and the muffler 21 due to vibration. Therefore, the cost can be reduced.

Compared to the position adjustment by deforming the bellows 26 itself, the position adjusting operation is easy, and the assembly is easy.

In this case, the muffler mount 31 rotates around the first bolts 35 (pivots) provided at the lower ends of the leg portions 32 and 33 and performs a position adjusting function. Therefore, a substantial force is not needed for the operation. Just by rotating the muffler mount 31 slightly, a wide adjustment range A in the axial direction of the bellows (see FIG. 3) can be achieved. Therefore, the adjusting operation is facilitated.

Since the muffler mount 31 is gate-shaped and is provided so as to straddle the hydraulic pump 11, the muffler mount 31 does not interfere with the attaching and removal of the hydraulic pump 11, and the muffler 21 can be placed at the conventional position. That is, it is not necessary to rearrange or resize the hydraulic pump 11 and other surrounding devices, and the muffler mounting device can be easily applied to existing machines.

Since the gate-shaped mount 31 supports the weight of the muffler at both ends, and the mount 31 is attached to the longitudinal plate 3 serving as a strength member with the mounting brackets 29 and 30, the heavy muffler 21 with the exhaust emission control system 22 in this embodiment can be stably supported.

In addition, (i) as described above, the mount attaching members (the mounting brackets 29 and 30, the mounting holes 39 to 42, the bolts 35 and 36, and the nuts 37 and 38) serve as components of the position adjusting device, and (ii) the mounting brackets 29 and 30 for supporting the engine serve as mount attaching brackets. Therefore, the structure can be simplified, and the cost can be reduced.

The second mounting holes 42 may have substantially the same diameter as the diameter of the bolts, the first mounting holes 41 may have a diameter larger than the diameter of the bolts, and the muffler mount 31 may be rotated around the second bolts 36.

The leg portions 32 and 33 of the muffler mount 31 are horizontally bent at the upper end, that is, are formed in an inverted L shape. To these bent portions 32*a* and 33*a*, both ends of the muffler attaching portion 34 are joined with a pair of (left and right) bolts 43 and a pair of (left and right) nuts 44 each to construct the muffler mount 31.

The mounting holes 45 of the muffler attaching portion 34 are circular holes with substantially the same diameter as the diameter of the bolts 43, and the mounting holes 46 of the leg portions are circular holes with a diameter larger than the diameter of the bolts 43 (so-called clearance holes). The mounting holes 46 may be elongate holes that are long in the front-rear direction.

Figure 5:
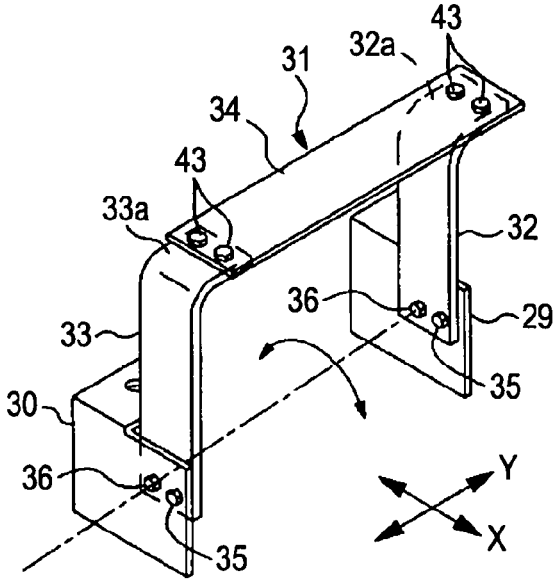
FIG. 5 is a perspective view of the mount in an assembled state.

Thus, the muffler attaching portion 34 is joined to the leg portions 32 and 33 so as to be movable relative to the leg portions 32 and 33 in the X direction and the direction perpendicular thereto (the Y direction shown in FIGS. 1, 2, and 5).

Since the muffler 21 can be positionally adjusted in the X direction at two points, the position adjustment range in the axial direction of the bellows is wide.

In addition, since position adjustment can also be performed in the direction perpendicular to the axial direction of the bellows, the assembly can be further facilitated.

The muffler 21 is attached to the muffler attaching portion 34 of the muffler mount 31 with L-shaped brackets 47 (see FIGS. 1 and 2) at the flange connections between the exhaust emission control system 22 and the silencers 23 and 24.

Other Embodiments (1) In the above embodiment, the muffler mount 31 is formed of three separate members: the front and rear leg portions 32 and 33 and the muffler attaching portion 34 in a gate shape. However, the leg portions 32 and 33 and the muffler attaching portion 34 may be formed integrally as a single member.

(2) In the above embodiment, the muffler mount 31 is formed in a gate shape. However, the muffler mount 31 may be formed in an inverted L shape such that the muffler attaching portion 34 extends from the upper end of the front or rear leg portion 32 or 33 forward or rearward horizontally, a T shape such that the muffler attaching portion 34 extends from the upper end of the front or rear leg portion 32 or 33 both forward and rearward horizontally, or a 90-degree turned T shape such that the muffler attaching portion 34 extends from the middle of the front or rear leg portion 32 or 33 forward or rearward horizontally.

(3) The mechanism for positionally adjusting the muffler mount 31 in the axial direction of the bellows is not limited to that of the above embodiment. For example, the leg portions 32 and 33 of the muffler mount 31 may be attached to the mounting brackets 29 and 30 with rollers or sliders therebetween so as to be movable in the axial direction of the bellows.

(4) In the above embodiment, the mounting brackets 29 and 30 for supporting the engine serve as mount attaching brackets. However, the upper frame of the upper rotating body may be provided with special mount attaching brackets.

Although the invention has been described with reference to the preferred embodiments in the attached figures, it is noted that equivalents may be employed and substitutions made herein without departing from the scope of the invention as recited in the claims.

What is claimed is:

1. A construction machine comprising:

a hydraulic pump connected to one end in the axial direction of an engine;

a muffler placed on the side of the engine to which the hydraulic pump is connected; and a muffler mounting device by which an inlet side of the muffler is connected through a bellows to an exhaust pipe of the engine, the muffler mounting device comprising:

a muffler mount to which the muffler is attached; and a position adjusting device by which the muffler mount is provided on the muffler side of the engine so as to be positionally adjustable in the axial direction of the bellows, wherein the muffler mount includes at least one leg portion and a muffler attaching portion provided at the upper part of the at least one leg portion, the muffler is attached to the muffler attaching portion, the lower part of the at least one leg portion is attached to a mount attaching bracket provided in a frame of the construction machine so as to be rotatable around a pivot along the axial direction of the bellows, and the position adjusting device is thereby constructed, and wherein the at least one leg portion comprises a pair of leg portions which vertically extend at both sides of the hydraulic pump, respectively, and face each other with a space therebetween, the muffler mount is formed in a gate shape such that the muffler attaching portion is laid between the upper ends of the pair of leg portions over the hydraulic pump, to straddle the hydraulic pump.

2. The construction machine according to claim 1, wherein the at least one leg portion and the muffler attaching portion of the muffler mount are formed separately, and the muffler attaching portion is joined to the at least one leg portion so as to be movable relative to the at least one leg portion in the axial direction of the bellows.

3. The construction machine according to claim 1, wherein the at least one leg portion and the muffler attaching portion of the muffler mount are formed separately, and the muffler attaching portion is joined to the at least one leg portion so as to be movable relative to the at least one leg portion in the horizontal direction perpendicular to the axial direction of the bellows.

4. A construction machine comprising:

a hydraulic pump connected to one end in the axial direction of an engine;

a muffler placed on the side of the engine to which the hydraulic pump is connected; and a muffler mounting device by which an inlet side of the muffler is connected through a bellows to an exhaust pipe of the engine, the muffler mounting device comprising:

a muffler mount to which the muffler is attached; and a position adjusting device by which the muffler mount is provided on the muffler side of the engine so as to be positionally adjustable in the axial direction of the bellows, wherein the muffler mount includes at least one leg portion and a muffler attaching portion provided at the upper part of the at least one leg portion, the muffler is attached to the muffler attaching portion, the lower part of the at least one leg portion is attached to a mount attaching bracket provided in a frame of the construction machine so as to be rotatable around a pivot along the axial direction of the bellows, and the position adjusting device is thereby constructed, wherein the at least one leg portion of the muffler mount and the mount attaching bracket are each provided with first and second mounting holes through which bolts are passed, at least one of the second mounting holes is a clearance hole having a size such that the bolt has sufficient clearance when passed through the clearance hole, and the muffler mount is thereby attached rotatably around the bolt passed through the first mounting holes within the clearance of the clearance hole along the axial direction of the bellows.

5. The construction machine according to claim 4, wherein the at least one leg portion and the muffler attaching portion of the muffler mount are formed separately, and the muffler attaching portion is joined to the at least one leg portion so as to be movable relative to the at least one leg portion in the axial direction of the bellows.

6. The construction machine according to claim 4, wherein the at least one leg portion and the muffler attaching portion of the muffler mount are formed separately, and the muffler attaching portion is joined to the at least one leg portion so as to be movable relative to the at least one leg portion in the horizontal direction perpendicular to the axial direction of the bellows.

7. A construction machine comprising:

a hydraulic pump connected to one end in the axial direction of an engine;

a muffler placed on the side of the engine to which the hydraulic pump is connected; and a muffler mounting device by which an inlet side of the muffler is connected through a bellows to an exhaust pipe of the engine, the muffler mounting device comprising:

a muffler mount to which the muffler is attached; and a position adjusting device by which the muffler mount is provided on the muffler side of the engine so as to be positionally adjustable in the axial direction of the bellows, wherein the muffler mount includes at least one leg portion and a muffler attaching portion provided at the upper part of the at least one le ortion the muffler is attached to the muffler attaching portion, the lower part of the at least one leg portion is attached to a mount attaching bracket provided in a frame of the construction machine so as to be rotatable around a pivot along the axial direction of the bellows, and the position adjusting device is thereby constructed, wherein the mount attaching bracket is provided in a longitudinal plate provided in the frame of the construction machine in the front-rear direction and serving as a strength member.

8. A construction machine comprising:

a hydraulic pump connected to one end in the axial direction of an engine;

a muffler placed on the side of the engine to which the hydraulic pump is connected; and a muffler mounting device by which an inlet side of the muffler is connected through a bellows to an exhaust pipe of the engine, the muffler mounting device comprising:

a muffler mount to which the muffler is attached; and a position adjusting device by which the muffler mount is provided on the muffler side of the engine so as to be positionally adjustable in the axial direction of the bellows, wherein the muffler mount includes at least one leg portion and a muffler attaching portion provided at the upper part of the at least one leg portion, the muffler is attached to the muffler attaching portion, the lower part of the at least one leg portion is attached to a mount attaching bracket provided in a frame of the construction machine so as to be rotatable around a pivot along the axial direction of the bellows, and the position adjusting device is thereby constructed, wherein the muffler mount is attached to an engine mounting bracket that supports the engine, and the engine mounting bracket serves as a mount attaching bracket.

* * * * *